US007014185B2

(12) United States Patent
Östreicher et al.

(10) Patent No.: US 7,014,185 B2
(45) Date of Patent: Mar. 21, 2006

(54) SPRING-ACTION SUCTION HEAD

(75) Inventors: Michael Östreicher, Karlsruhe (DE); Jochen Renner, Edingen-Neckarhausen (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 0 days.

(21) Appl. No.: 10/694,600

(22) Filed: Oct. 27, 2003

(65) Prior Publication Data

US 2004/0084834 A1 May 6, 2004

(30) Foreign Application Priority Data

Oct. 25, 2002 (DE) ..... 102 49 730
Sep. 1, 2003 (DE) ..... 103 40 172

(51) Int. Cl.
*B65H 3/08* (2006.01)

(52) U.S. Cl. ..... 271/90; 271/107; 271/108; 221/211; 294/64.1; 294/64.2; 294/65

(58) Field of Classification Search ..... 271/90, 271/107, 108; 221/211; 294/64.1, 64.2, 294/65

See application file for complete search history.

(56) References Cited

U.S. PATENT DOCUMENTS

| | | | | |
|---|---|---|---|---|
| 3,695,606 | A | 10/1972 | Wirz | |
| 3,973,682 | A * | 8/1976 | Neff | 414/627 |
| 4,266,905 | A * | 5/1981 | Birk et al. | 414/627 |
| 4,399,990 | A * | 8/1983 | Jiruse | 271/90 |
| 4,736,938 | A * | 4/1988 | Jiruse et al. | 271/90 |
| 4,759,537 | A * | 7/1988 | Illig et al. | 271/11 |
| 4,869,489 | A * | 9/1989 | Wirz et al. | 271/90 |
| 5,447,300 | A * | 9/1995 | Junger | 271/11 |
| 6,244,640 | B1 * | 6/2001 | Le Bricquer et al. | 294/64.1 |

FOREIGN PATENT DOCUMENTS

| | | |
|---|---|---|
| DE | 932 495 | 9/1955 |
| DE | 1 782 267 | 2/1959 |
| DE | 1 929 714 | 5/1974 |
| JP | 62-249834 | * 10/1987 |

* cited by examiner

*Primary Examiner*—Donald Walsh
*Assistant Examiner*—Thomas Morrison
(74) *Attorney, Agent, or Firm*—Laurence A. Greenberg; Werner H. Stemer; Ralph E. Locher

(57) ABSTRACT

In a spring-action suction head for separating sheets from a sheet stack, a first suction chamber, which can be subjected to vacuum is provided for lifting the sheet. The first suction chamber is surrounded coaxially by a second suction chamber, which can be subjected to vacuum, for holding and lowering the spring-action suction head in a controlled manner.

23 Claims, 5 Drawing Sheets

SPRING-ACTION SUCTION HEAD

BACKGROUND OF THE INVENTION

FIELD OF THE INVENTION

The invention relates to a spring-action suction head on a separating device for sheets, in particular for lifting sheets from a sheet stack of a sheet processing machine, e.g. a printing press.

It is necessary here for a suction head which can be acted on pneumatically to attract the sheet by suction in a lower position, for it to lift the sheet to a higher level and remain in the upper position for a short time after letting go of the sheet, until the suction head is again lowered onto the sheet stack to lift a subsequent sheet.

German Patent DE 1 929 714 C discloses a mechanical gear mechanism that holds the spring-action suction head in a raised position and lowers it initially quickly and, in the lower region, slowly, in order to pick up the subsequent sheet. Mechanical gear mechanisms are very expensive, however, and require a large amount of installation space.

German Patent DE 932 495 discloses a spring-action suction head that is equipped with a pneumatic configuration for holding the spring-action suction head in a raised position. In the case of the spring-action suction head according to DE 932 495, it is, however, not possible to control the lowering speed of the spring-action suction head.

SUMMARY OF THE INVENTION

It is accordingly an object of the invention to provide a spring-action suction head that overcomes the above-mentioned disadvantages of the prior art devices of this general type, which makes it possible to hold the spring-action suction head pneumatically in a raised position, the intention being also to make retarded lowering of the spring-action suction head in order to pick up a subsequent sheet possible.

With the foregoing and other objects in view there is provided, in accordance with the invention, a spring-action suction head. The suction head contains a first suction chamber having a volume for lifting the spring-action suction head and the volume being varied by applying a vacuum, and a second suction chamber coaxially surrounding the first suction chamber for holding the spring-action suction head and for reducing a lowering speed of the spring-action suction head.

It is an advantage of the invention that the device according to the invention requires only a small amount of installation space and that the retarded lowering and gentle contact between the spring-action suction head and the sheets which are to be separated prevent double or multiple sheets from being attracted by suction. This measure ensures a continuous sheet feed free of disturbances.

In accordance with an added feature of the invention, a controlled vacuum supply fluidically communicates with the second suction chamber.

In accordance with another feature of the invention, an adjustable cross-flow channel is provided and the second suction chamber is operatively connected to the adjustable cross-flow channel. Preferably, the adjustable cross-flow channel has an adjustable length.

In accordance with an additional feature of the invention, a lifting cylinder delimits both the first suction chamber and the second suction chamber. Preferably, the lifting cylinder has at least one non-return valve. The non-return valve is disposed in a through opening between the second suction chamber and atmosphere.

In accordance with a further feature of the invention, dedicated rotary valves are provided and include a first rotary valve connected to the first suction chamber and a second rotary valve connected to the second suction chamber.

In accordance with a further added feature of the invention, an adjustable restrictor is provided and the second rotary valve is connected to the atmosphere through the adjustable restrictor. It is thus possible to ventilate the second suction chamber through the adjustable restrictor.

In accordance with another additional feature of the invention, the adjustable cross-flow channel has a bore that is disposed axially parallel to the lifting cylinder. The second suction chamber has at least one opening connecting the second suction chamber to the bore of the cross-flow channel. A closing element is disposed in the bore of the adjustable cross-flow channel, the bore has an operable length being adjusted by a position of the closing element in the bore. Optionally, the opening in the second suction chamber is one of a plurality of openings connecting the second suction chamber to the bore. The positioning of the closing element determines the number of the openings available for fluidically communicating between the second suction chamber and the bore.

Other features which are considered as characteristic for the invention are set forth in the appended claims.

Although the invention is illustrated and described herein as embodied in a spring-action suction head, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
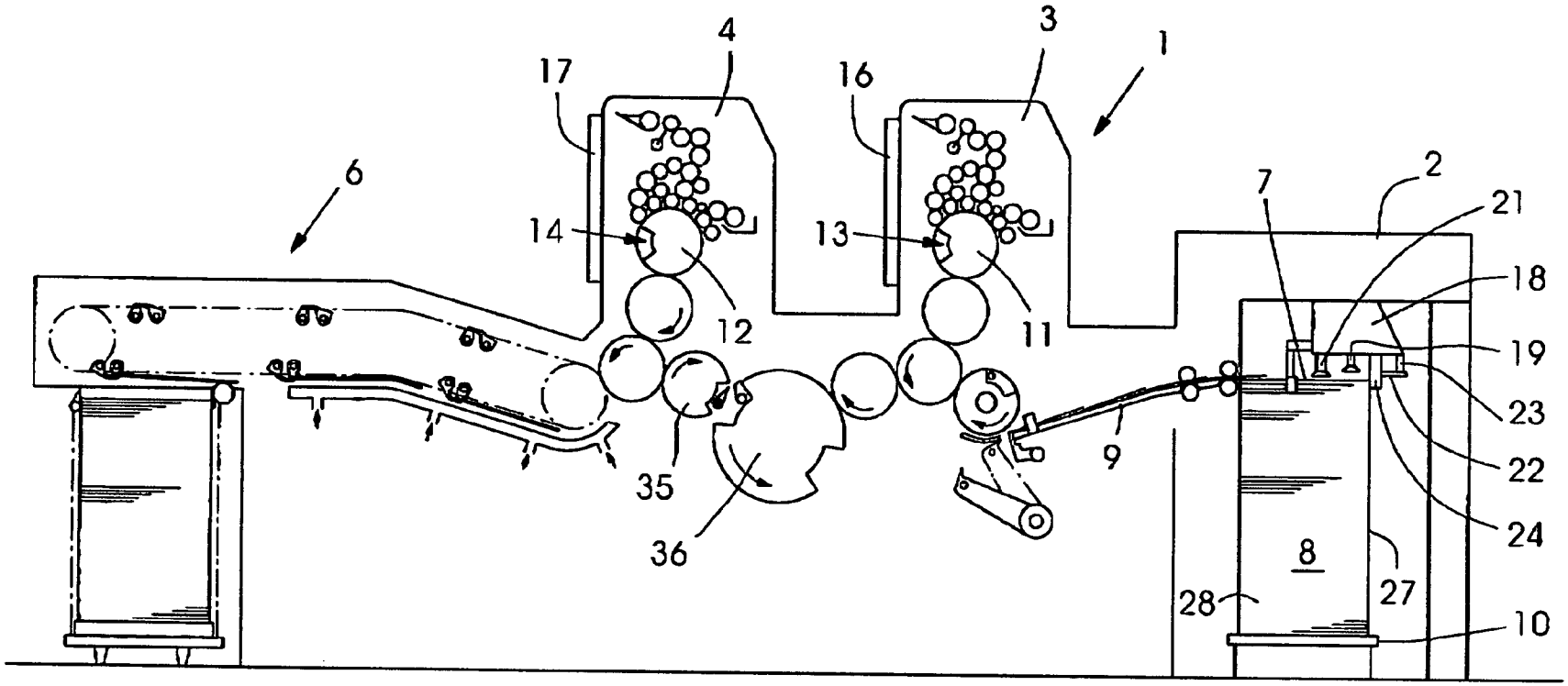
FIG. 1 is a schematic representation of a sheet fed rotary press.

Referring now to the figures of the drawing in detail and first, particularly, to FIG. 1 thereof, there is shown a rotary press 1. The press 1 processes sheets 7 and has a feeder 2, at least one printing unit 3 and 4 and a deliverer 6. The sheets 7 are taken from a sheet stack 8 and, separated or overlapped, are fed over a feed table 9 to the printing units 3 and 4. The latter each contain a plate cylinder 11; 12 in a known manner. The plate cylinders 11 and 12 each have a device 13, 14 for fixing flexible printing plates. Furthermore, each plate cylinder 11; 12 is assigned a device 16; 17 for semiautomatically or fully automatically changing a printing plate.

The sheet stack 8 lies on a stack plate 10 which can be raised under control. The removal of the sheets 7 takes place from the top of the sheet stack 8 by a suction head 18, as it is known, which inter alia has a number of lifting and dragging suction heads 19, 21 to separate the sheets 7. Furthermore, blowing devices 22 for loosening the top sheet layers and sensing elements 23 for tracking the stack are provided. In order to align the sheet stack 8, in particular the top sheets 7 of the sheet stack 8, a number of side and rear stops are provided.

Figure 2:
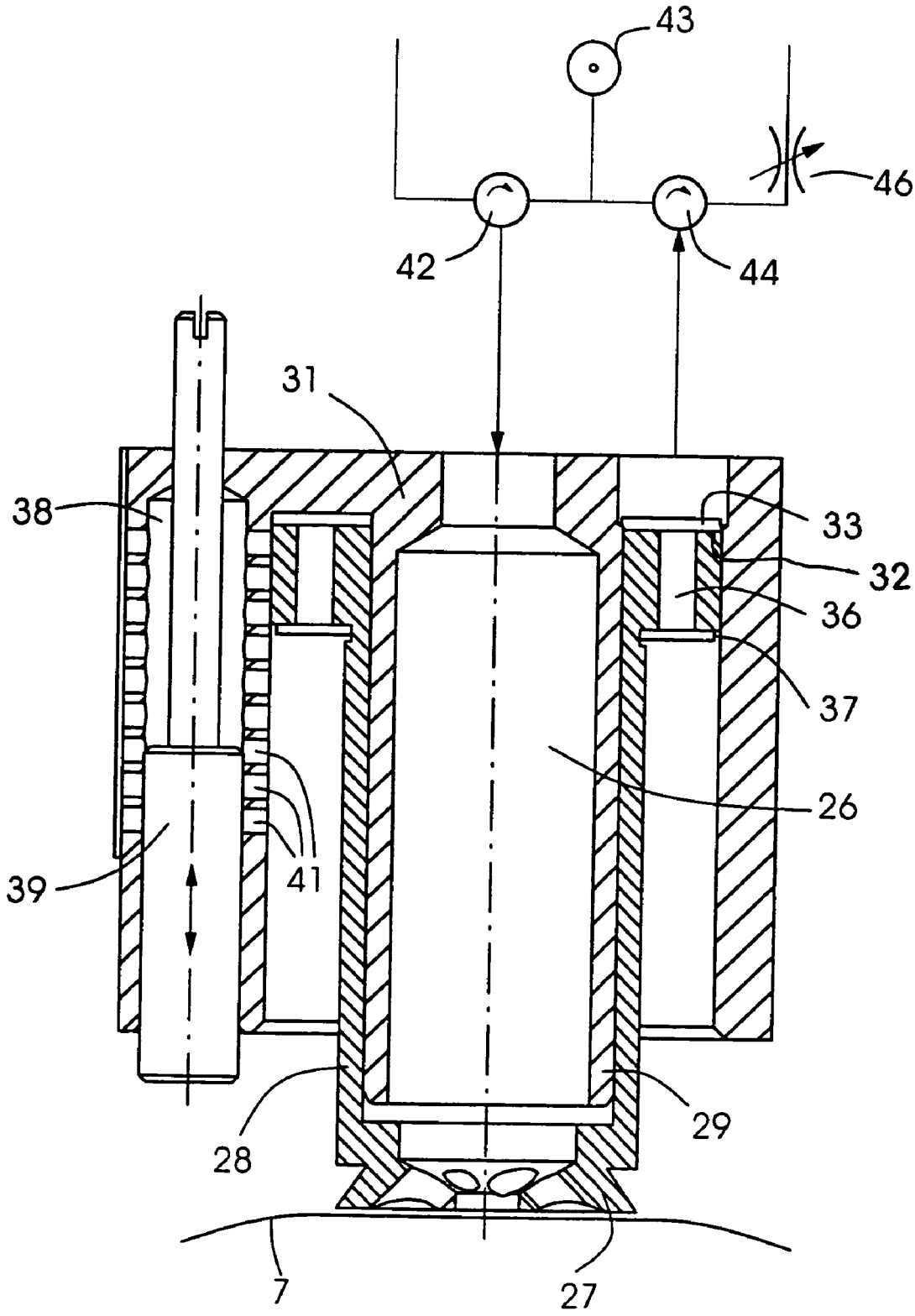
FIG. 2 is a diagrammatic, sectional view through a spring-action suction head according to the invention in a raised position.

The lifting suction heads 19 are configured as spring-action suction heads, as they are known, i.e. the volume of a first suction chamber 26 is changed when the first suction chamber 26 is subjected to vacuum and at the same time a suction nozzle 27 is covered by the sheet 7 to be separated, the change in volume causing the suction nozzle 27 and thus the sheet 7 to be raised (FIG. 2). The suction nozzle 27 is disposed at the end of a cylindrical body or lifting cylinder 28 that is guided on a cylindrical tube 29 of a spring-action suction head housing 31. Here, the tube 29 and suction nozzle 27 and the sheet 7 form the first suction chamber 26. At the end remote from the suction nozzle 27, the cylinder body 28 has an outer collar 32 which, configured as a piston, closes off a cylindrical second suction chamber 33 which surrounds the first suction chamber 26 coaxially. Disposed in the outer collar 32 are a number of through openings, or at least one through opening 36, which each have a non-return valve 37.

An adjustable closing element 39 is disposed in a bore 38 that is axially parallel to both the first suction chamber 26 and the second suction chamber 33. The bore 38 is connected to the second suction chamber 33 by a number of openings 41 disposed in the axial direction, or by a longitudinal slot. It is possible to set the length of the bore or cross-flow channel 38 by adjusting the closing element 39.

Via a first rotary valve 42, it is possible to connect the first suction chamber 26, in a controlled manner, to a vacuum source 43 or to atmosphere. Via a second rotary valve 44, it is possible to connect the second suction chamber 33, in a controlled manner, to the vacuum source 43 or to atmosphere, an adjustable restrictor 46 being connected between the rotary valve 44 and atmosphere.

FIG. 2 shows the spring-action suction head 19 in a raised position; the suction nozzle 27 is covered here by a sheet 7. There is a vacuum in the first suction chamber 26. The sheet 7 is then released as a result of the first rotary valve 42 connecting the suction chamber 26 to atmosphere. At approximately the same time, the second rotary valve 44 connects the second suction chamber 33 to the vacuum source 43, so that the cylinder 28 is held in the upper position.

Figure 3:
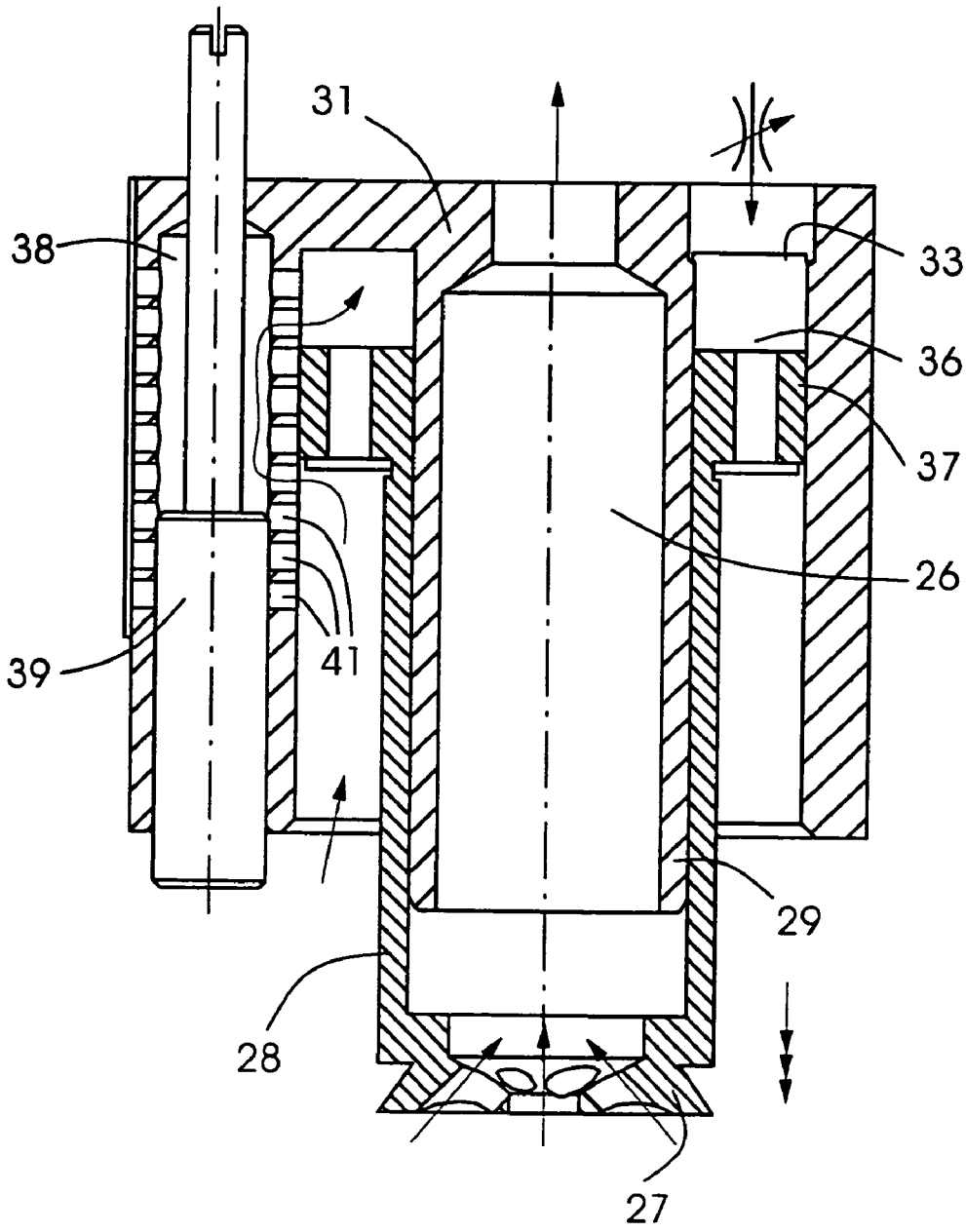
FIG. 3 is diagrammatic, sectional view of the spring-action suction head according to the invention during its rapid downward movement.

FIG. 3 shows the cylinder 28 of the spring-action suction head 19 in a somewhat lowered position. Here, the second rotary valve 44 connects the second suction chamber 33 to atmosphere, so that the spring-action suction head 19 falls downward as a result of its inherent weight or an additional spring. In the region of the openings 41 of the bore 38, the second suction chamber 33 is additionally ventilated through the openings 41, so that a lowering movement of the spring-action suction head 19 proceeds relatively rapidly.

Figure 4:
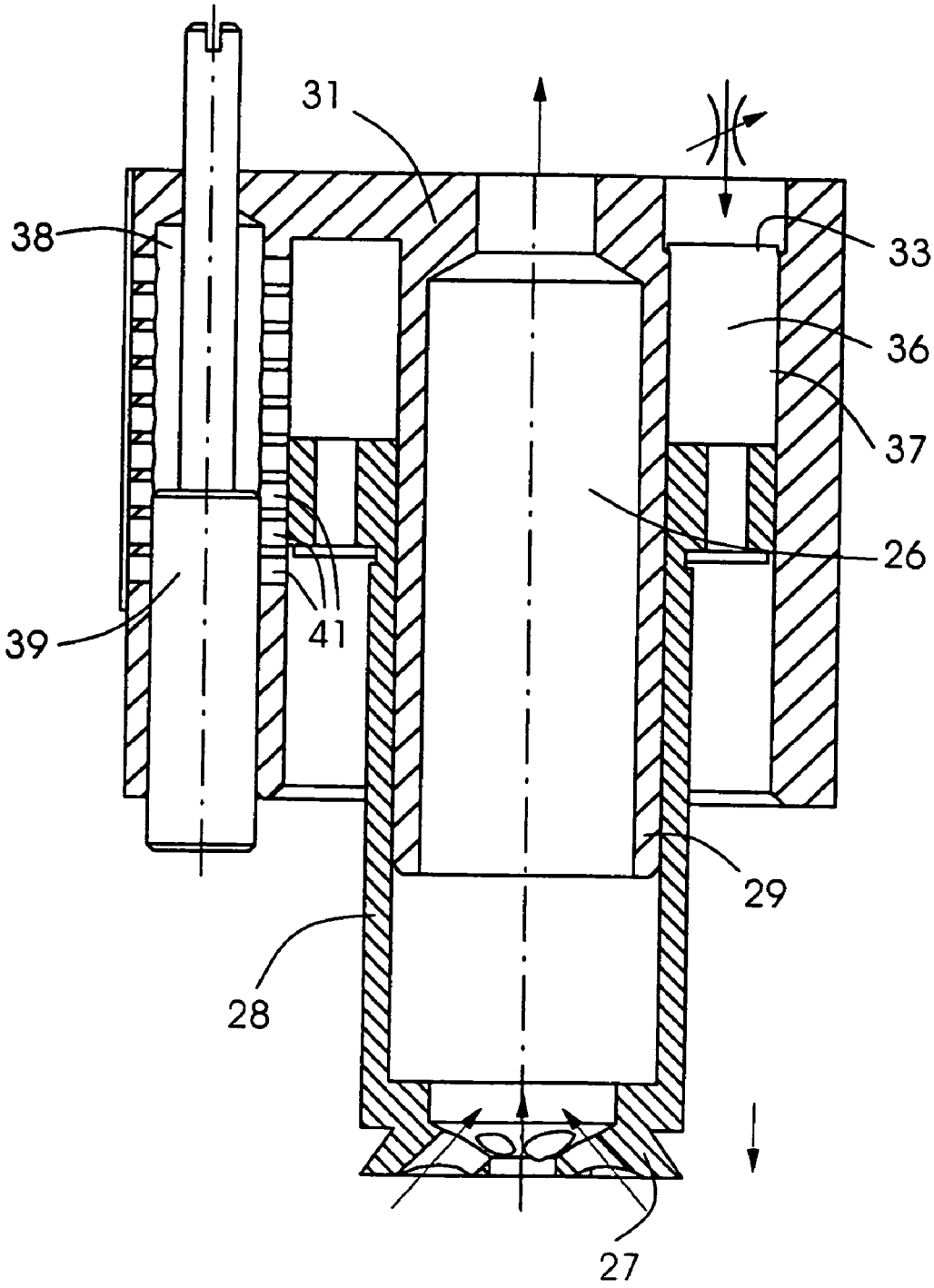
FIG. 4 is a diagrammatic, sectional view of the spring-action suction head according to the invention during a retarded downward movement.

FIG. 4 shows the spring-action suction head 19 in a position shortly before it reaches the lowest suction position. The openings 41 are now closed and do not permit any further ventilation of the second suction chamber 33, so that the latter is ventilated merely via the adjustable restrictor 46. This has the consequence that the lowering speed of the spring-action suction head 19 is braked and the latter can come into contact gently with the new sheet 7.

Figure 5:
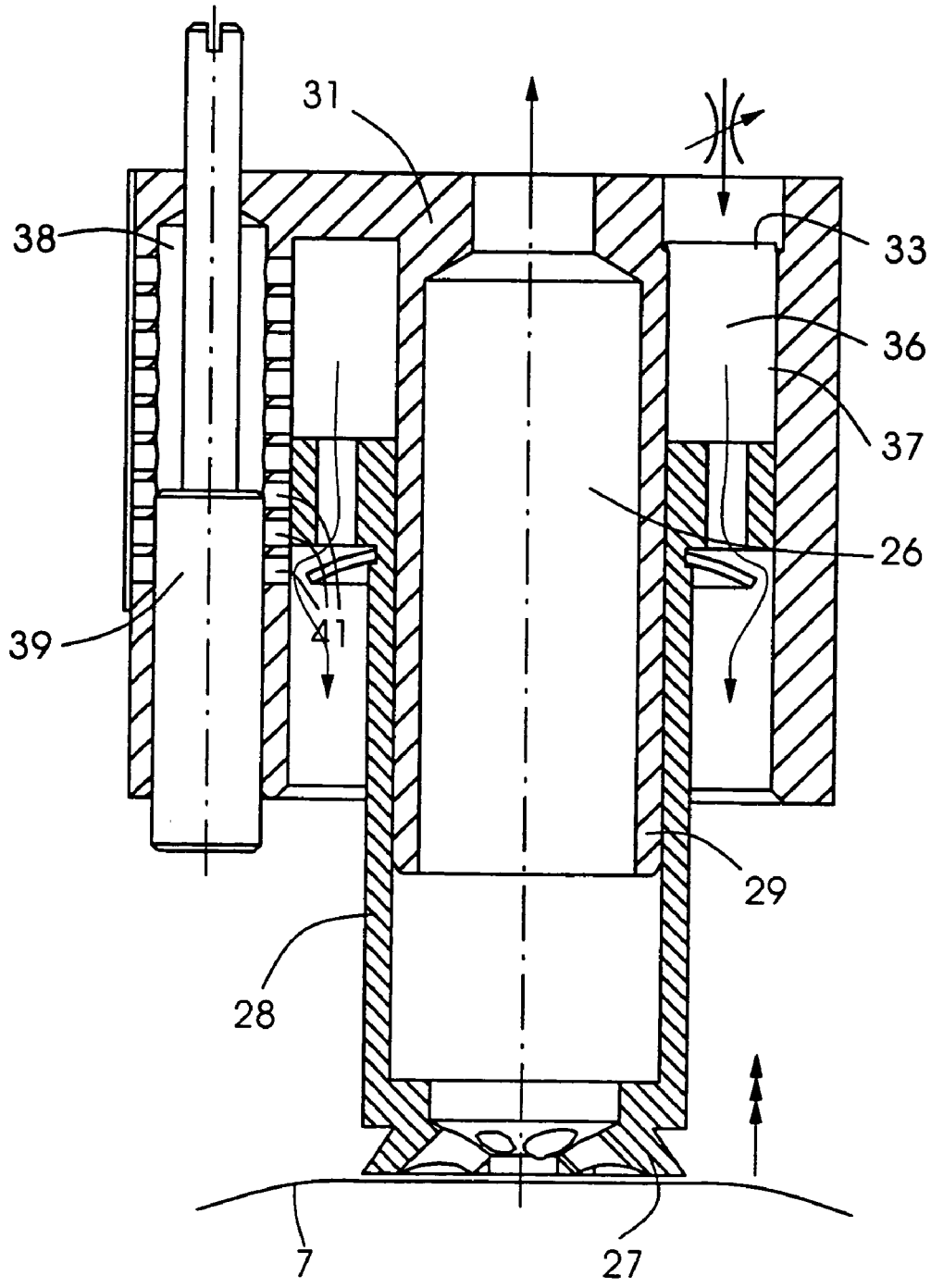
FIG. 5 is a diagrammatic, sectional view of the spring-action suction head according to the invention during its rapid upward movement.

FIG. 5 shows the spring-action suction head 19 during its lifting movement at high speed. Here, the suction nozzle 27 is covered by the sheet 7. The first rotary valve 42 supplies vacuum to the first suction chamber 26 and pulls the spring-action suction head 19 together with the sheet 7 upward. At the same time, the second suction chamber 33 is ventilated via the non-return valve 37 in the piston 32.

It is of course also possible to implement the ventilation of the second suction chamber 33 by earlier activation of the second rotary valve 44 with vacuum.

We claim:

1. A spring-action suction head, comprising: a lifting cylinder;

a first suction chamber having a volume being varied by applying a vacuum, said first suction chamber being operatively connected to said lifting cylinder for lifting said lifting cylinder from a first position to a second position;

a second suction chamber coaxially surrounding said first suction chamber and operatively connected to said lifting cylinder for holding said lifting cylinder in the second position; and a cross-flow channel having a closeable connection to ambient surroundings being operatively connected to said second suction chamber such that when said lifting cylinder is released from being held in the second position, a lowering speed of said lifting cylinder is reduced during movement of said lifting cylinder from the second position to the first position.

2. The spring-action suction head according to claim 1, further comprising a controlled vacuum supply fluidically communicating with said second suction chamber.

3. The spring-action suction head according to claim 1, wherein said cross-flow channel is an adjustable cross-flow channel.

4. The spring-action suction head according to claim 3, wherein said adjustable cross-flow channel has an adjustable length.

5. The spring-action suction head according to claim 4, wherein said lifting cylinder delimits both said first suction chamber and said second suction chamber.

6. The spring-action suction head according to claim 5, wherein said lifting cylinder has at least one non-return valve.

7. The spring-action suction head according to claim 6, wherein said non-return valve is disposed in a through opening between said second suction chamber and atmosphere.

8. The spring-action suction head according to claim 2, further comprising dedicated rotary valves including a first rotary valve connected to said first suction chamber and a second rotary valve connected to said second suction chamber.

9. The spring-action suction head according to claim 8, further comprising an adjustable restrictor and said second rotary valve is connected to atmosphere through said adjustable restrictor and it is thus possible to ventilate said second suction chamber through said adjustable restrictor.

10. The spring-action suction head according to claim 5, wherein:

said adjustable cross-flow channel has a bore formed therein and disposed axially parallel to said lifting cylinder; and said second suction chamber has at least one opening formed therein connecting said second suction chamber to said bore of said cross-flow channel.

11. The spring-action suction head according to claim 10, further comprising a closing element disposed in said bore of said adjustable cross-flow channel, said bore having an operable length being adjusted by a position of said closing element in said bore; and wherein said at least one opening in said second suction chamber being one of a plurality of openings connecting said second suction chamber to said bore, and said closing element determining a number of said plurality of openings being available for fluidically communicating between said second suction chamber and said bore.

12. A spring-action suction head, comprising:

a lifting cylinder;

a housing supporting said lifting cylinder, said housing defining a first suction chamber having a volume being varied by applying a vacuum, said first suction chamber being operatively connected to said lifting cylinder for lifting said lifting cylinder from a first position to a second position, a second suction chamber coaxially surrounding said first suction chamber and operatively connected to said lifting cylinder for holding said lifting cylinder in the second position, and a closeable cross-flow channel having a connection to ambient surroundings and being operatively connected to said second suction chamber such that when said lifting cylinder is released from being held in the second position, a lowering speed of said lifting cylinder is reduced during movement of said lifting cylinder from the second position to the first position.

13. The spring-action suction head according to claim 12, further comprising a controlled vacuum supply fluidically communicating with said second suction chamber.

14. The spring-action suction head according to claim 12, wherein said cross-flow channel is an adjustable cross-flow channel.

15. The spring-action suction head according to claim 14, wherein said adjustable cross-flow channel has an adjustable length.

16. The spring-action suction head according to claim 15, wherein said lifting cylinder delimits both said first suction chamber and said second suction chamber.

17. The spring-action suction head according to claim 16, wherein said lifting cylinder has at least one non-return valve.

18. The spring-action suction head according to claim 17, wherein said non-return valve is disposed between said second suction chamber and atmosphere.

19. The spring-action suction head according to claim 13, further comprising dedicated rotary valves including a first rotary valve connected to said first suction chamber and a second rotary valve connected to said second suction chamber.

20. The spring-action suction head according to claim 19, further comprising an adjustable restrictor and said second rotary valve is connected to atmosphere through said adjustable restrictor and it is thus possible to ventilate said second suction chamber through said adjustable restrictor.

21. The spring-action suction head according to claim 16, wherein:

said adjustable cross-flow channel has a bore formed therein and disposed axially parallel to said lifting cylinder; and said second suction chamber has at least one opening formed therein connecting said second suction chamber to said bore of said cross-flow channel.

22. The spring-action suction head according to claim 21, further comprising a closing element disposed in said bore of said adjustable cross-flow channel, said bore having an operable length being adjusted by a position of said closing element in said bore; and wherein said at least one opening in said second suction chamber being one of a plurality of openings connecting said second suction chamber to said bore, and said closing element determining a number of said plurality of openings being available for fluidically communicating between said second suction chamber and said bore.

23. The spring-action suction head according to claim 1, wherein said lifting cylinder is disposed at said first suction chamber, said connection to ambient surroundings being closeable by the movement of said lifting cylinder from the second position to the first.

* * * * *